US007024305B2

(12) United States Patent
Stamm et al.

(10) Patent No.: US 7,024,305 B2
(45) Date of Patent: Apr. 4, 2006

(54) AIRFLOW VARIATION LEARNING USING ELECTRONIC THROTTLE CONTROL

(75) Inventors: David A. Stamm, Howell, MI (US); Todd R. Shupe, Milford, MI (US)

(73) Assignee: General Motors Corporation, Detroit, MI (US)

( * ) Notice: Subject to any disclaimer, the term of this patent is extended or adjusted under 35 U.S.C. 154(b) by 55 days.

(21) Appl. No.: 10/689,184

(22) Filed: Feb. 20, 2004

(65) Prior Publication Data

US 2005/0187699 A1 Aug. 25, 2005

(51) Int. Cl.
*G06G 7/70* (2006.01)

(52) U.S. Cl. ..... 701/114; 123/494; 123/361; 123/399; 701/102; 701/103; 701/104; 73/118.2

(58) Field of Classification Search ..... 701/114, 701/102, 103, 104; 73/118.2; 123/361, 123/339, 494

See application file for complete search history.

(56) References Cited

U.S. PATENT DOCUMENTS 6,698,398 B1 * 3/2004 Bauerle ..... 123/399

* cited by examiner

*Primary Examiner*—Tony M. Argenbright
*Assistant Examiner*—Johnny H. Hoang
(74) *Attorney, Agent, or Firm*—Christopher DeVries

(57) ABSTRACT

A throttle area compensation system for use with an electronic throttle control of a vehicle includes a compensation datastore of compensation values indexed by pre-compensated throttle area. A compensation vector learning module receives a pre-compensated throttle area and at least one sensed vehicle condition, and informs the compensation datastore based on the pre-compensated throttle area and the sensed vehicle condition. A throttle area compensation module communicates with the compensation datastore, receives the pre-compensated throttle area, and determines a compensated throttle area based on the pre-compensated throttle area and a corresponding compensation value of the compensation data store.

23 Claims, 6 Drawing Sheets

AIRFLOW VARIATION LEARNING USING ELECTRONIC THROTTLE CONTROL

FIELD OF THE INVENTION

The present invention generally relates to vehicle electronic throttle control, and more particularly to throttle area compensation systems and methods in a vehicle throttle control.

BACKGROUND OF THE INVENTION

Engine control systems employ electronic throttle control (ETC) systems that relate commanded throttle position and airflow, which improve driving performance and stable idle speed. The ETC systems, however, do not adapt to airflow variation due to throttle body deposits, throttle sensor variation, mass airflow meter variation, and manufacturing tolerances.

Throttle body deposits commonly occur in internal combustion engines during operation. Understanding and compensating for throttle body deposits is challenging. Statistical build variations in the ETC system components can alter the relationship between throttle position and airflow.

SUMMARY OF THE INVENTION

A throttle area compensation system for use with an electronic throttle control of a vehicle includes a compensation datastore of compensation values indexed by desired throttle area, also referred to as pre-compensated throttle area. A compensation vector learning module receives a desired throttle area and at least one sensed vehicle condition, and informs the compensation datastore based on the desired throttle area and the sensed vehicle condition. A throttle area compensation module communicates with the compensation datastore, receives the desired throttle area, and determines a compensated throttle area based on the desired throttle area and a corresponding compensation value of the compensation data store.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
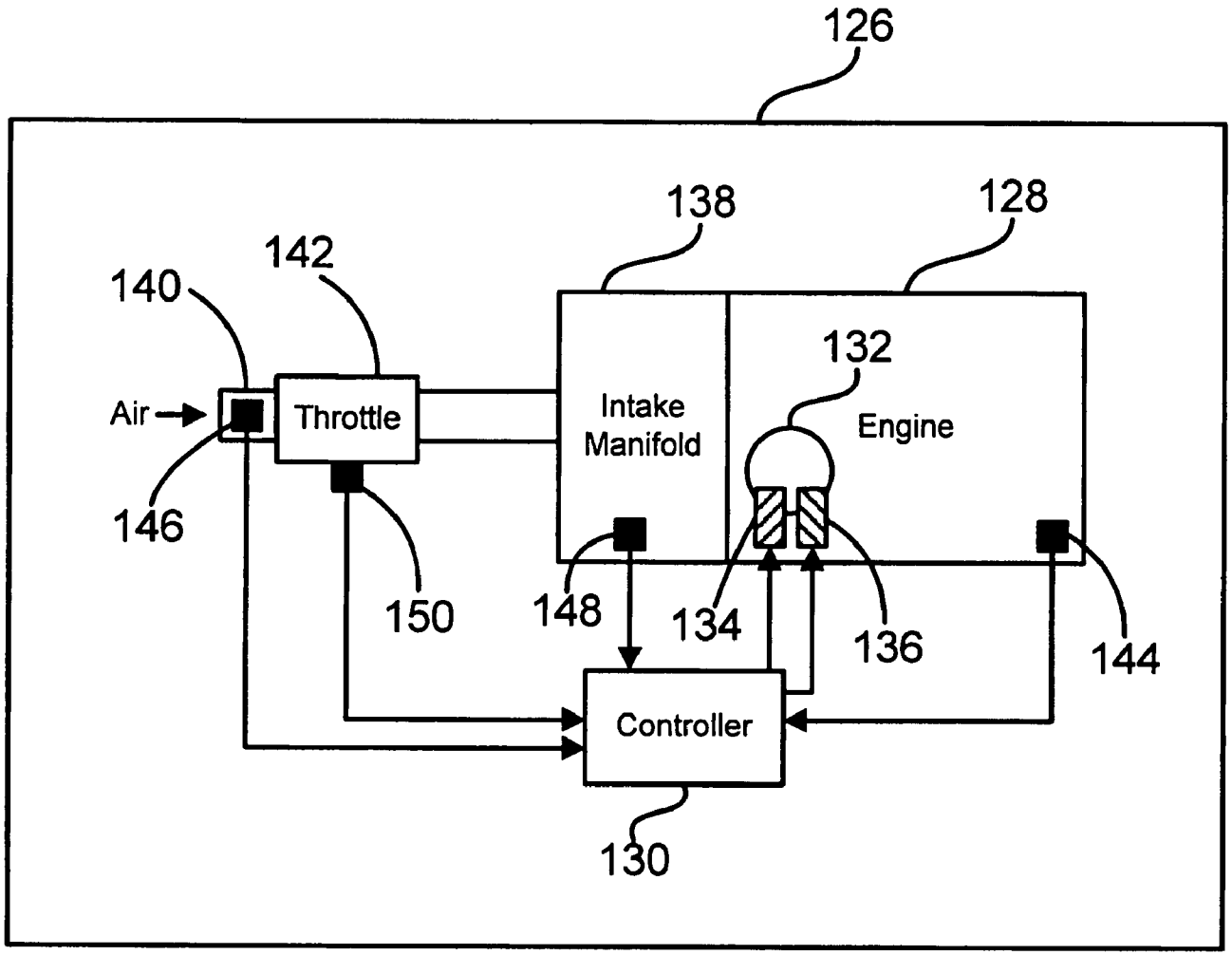
FIG. 1 is a block diagram of a vehicle in accordance with the present invention.

Referring now to FIG. 1, a vehicle 126 is shown and includes an engine 128 and a controller 130. The engine 128 includes a cylinder 132 having a fuel injector 134 and a spark plug 136. Although a single cylinder 132 is shown, it will be appreciated that the engine 128 typically includes multiple cylinders 132 with associated fuel injectors 134 and spark plugs 136. For example, the engine 128 may include 4, 5, 6, 8, 10, or 12 cylinders 132.

Air is drawn into an intake manifold 138 of the engine 128 through an inlet 140. A throttle 142 regulates the air flow through the inlet 140. Fuel and air are combined in the cylinder 132 and are ignited by the spark plug 136. The throttle 142 is actuated to control air flowing into the intake manifold 138. The controller 130 adjusts the flow of fuel through the fuel injector 134 based on the air flowing into the cylinder 132 to control the A/F ratio within the cylinder 132.

The controller 130 communicates with an engine speed sensor 144, which generates an engine speed signal. The controller 130 also communicates with mass air flow (MAF) and manifold absolute pressure (MAP) sensors 146 and 148, which generate MAF and MAP signals respectively. The controller 130 communicates with a throttle position sensor (TPS) 150, which generates a TPS signal.

Figure 2:
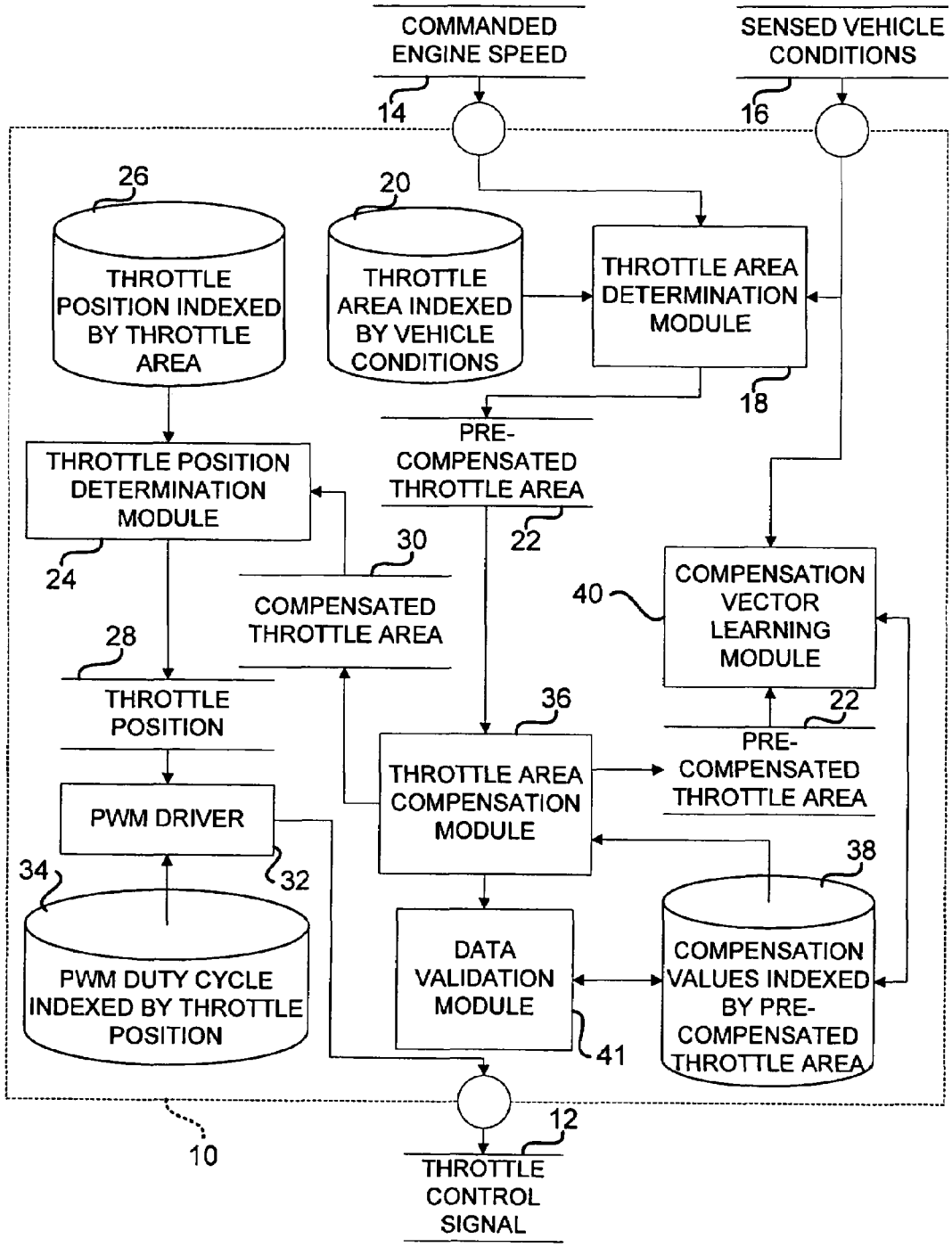
FIG. 2 is a block diagram depicting an electronic throttle control system in accordance with the present invention.

By way of overview and with reference to FIG. 2, the present invention is implemented with a vehicle electronic throttle control system 10 that employs several modules. These modules interact to generate throttle control signal 12 based on commanded engine speed 14 and sensed vehicle conditions 16. For example, system 10 includes throttle area determination module 18 having datastore 20 of desired or pre-compensated throttle area indexed by vehicle conditions, such as commanded engine speed 14. Datastore 20 and other datastores of the present invention include a map and/or other data structure stored in memory. The conditions indexing throttle area of datastore 20 further include one or more sensed vehicle conditions 16. In operation, module 18 generates desired or pre-compensated throttle area 22 based on three criteria: contents of datastore 20; commanded engine speed 14; and one or more sensed vehicle conditions 16. Also, system 10 includes throttle position determination module 24 having datastore 26 of throttle position indexed by throttle area. In operation, module 18 generates throttle position 28 based on two criteria: contents of datastore 26; and compensated throttle area 30. Further, system 10 includes Pulse Width Modulated (PWM) driver 32 having datastore 34 of PWM duty cycle indexed by throttle position. In operation, PWM driver 32 utilizes throttle position 28 and contents of datastore 34 to generate throttle control signal 12. Signal 12 is further utilized to command the vehicle throttle to obtain commanded engine speed 14.

The present invention employs a throttle area compensation subsystem to generate compensated throttle area 30 based on desired or pre-compensated throttle area 22 and one or more of sensed vehicle conditions 16. For example, system 10 includes throttle area compensation module 36, having datastore 38 of compensation values indexed by desired throttle area. In operation, throttle area compensation module 36 obtains a compensation value for desired or pre-compensated throttle area 22 from datastore 38, and generates compensated throttle area 30 based on two criteria: desired or pre-compensated throttle area 22 and the corresponding compensation value obtained from datastore 38. Also, system 10 includes compensation vector learning module 40, which is adapted to inform datastore 38 on a regular basis during vehicle operation based on two criteria: desired or pre-compensated throttle area 22; and one or more sensed vehicle conditions 16. Further, system 10 includes data validation module 41, which analyzes datastore 38 on a regular basis during vehicle operation. This analysis is performed to determine whether the information stored in datastore 38 is valid based on predetermined criteria. Validation module 41 takes one or more measures to ensure that invalid data is not used by module 36 to generate compensated throttle area 30. The predetermined criteria may relate to a slope and/or magnitude of the data, while the measures may include reinitializing datastore 38 whenever the data is deemed invalid.

Figure 3:
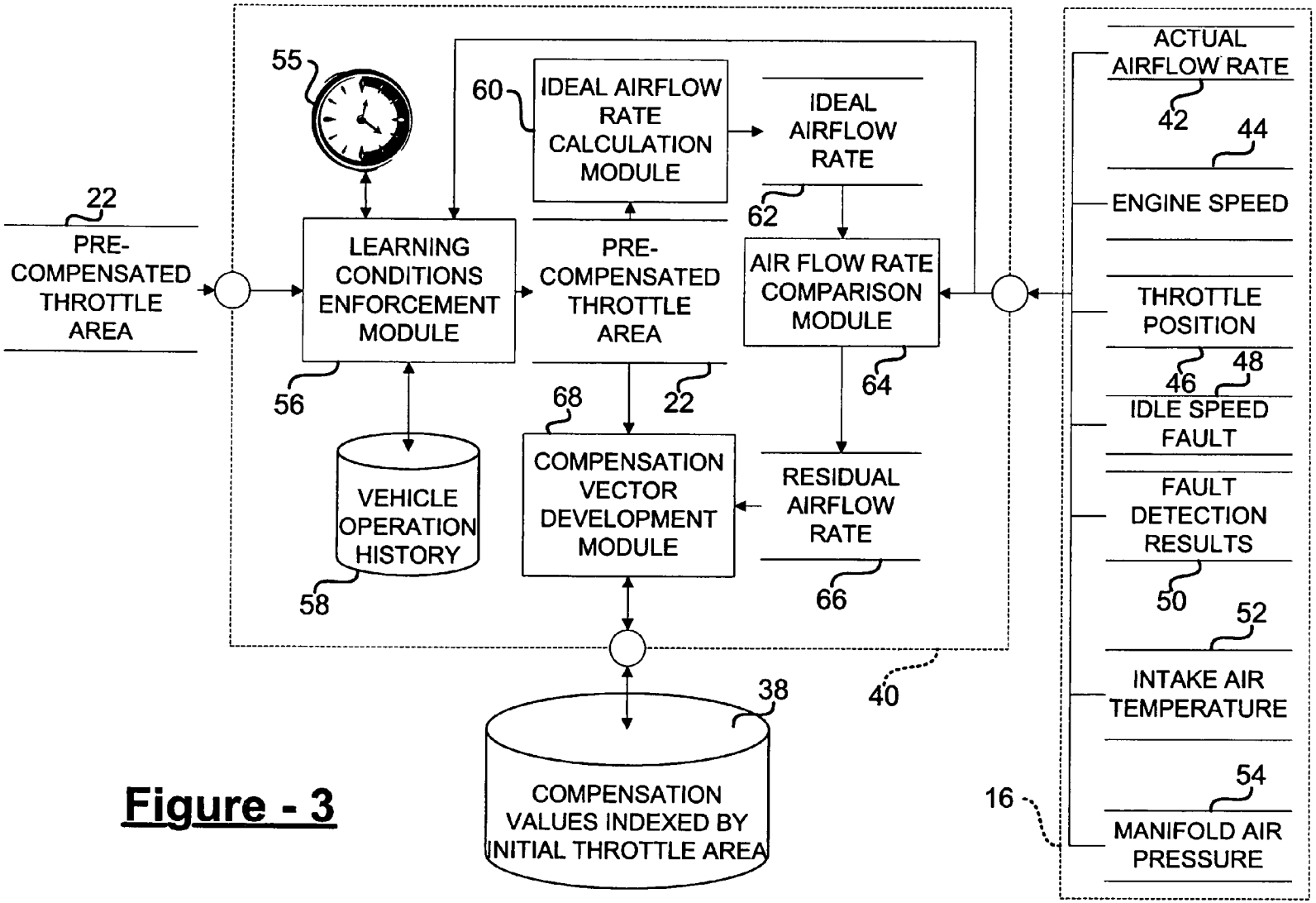
FIG. 3 is a block diagram of a compensation vector learning module in accordance with the present invention.

As illustrated in FIG. 3, compensation vector learning module 40 utilizes several modules to inform datastore 38 based on desired or pre-compensated throttle area 22 and sensed vehicle conditions 16. The sensed vehicle conditions include actual airflow rate 42, engine speed 44, throttle position 46, idle speed 48, fault detection results 50, intake air temperature 52, manifold air pressure 54, and/or other operating parameters. For example, module 40 includes learning conditions enforcement module 56 having datastore 58 of vehicle operation history. In operation, module 56 determines whether to update datastore 38 in a particular cycle based on predetermined criteria. These criteria relate to fault detection results 50, airflow rate 42 stability, engine speed 44 range, the age of sensed vehicle conditions 16, correlation of air pressure 54 with air flow rate 42, passage of time 55, range of change in throttle position 46, indication of a desired change in throttle area 22, indication of engine idle speed faults 48, and/or range of desired or pre-compensated throttle area 22. Sensed vehicle conditions 16 are stored in datastore 58 to help determine changes in conditions over time, and to determine whether a change in throttle area is desired. Therefore, module 56 may permit learning to occur if the predetermined conditions are met. Also, module 40 includes ideal airflow rate calculation module 60, which calculates ideal airflow rate 62 based on desired or pre-compensated throttle area 22 and various constants in accordance with an ideal airflow equation. Further, module 40 includes air flow rate comparison module 64, which generates residual airflow rate 66 based on a comparison between the ideal airflow rate 62 and the actual airflow rate 42. In order to improve accuracy and reduce variation in throttle area compensation, a predetermined number of generated residual airflow rates may be stored in memory for a time and averaged together with a currently generated residual airflow rate to obtain rate 66. Still further, module 40 includes compensation vector development module 68, which develops and maintains datastore 38 based on three criteria: desired or pre-compensated throttle area 22; residual airflow rate 66; and existing contents of datastore 38.

Figure 4:
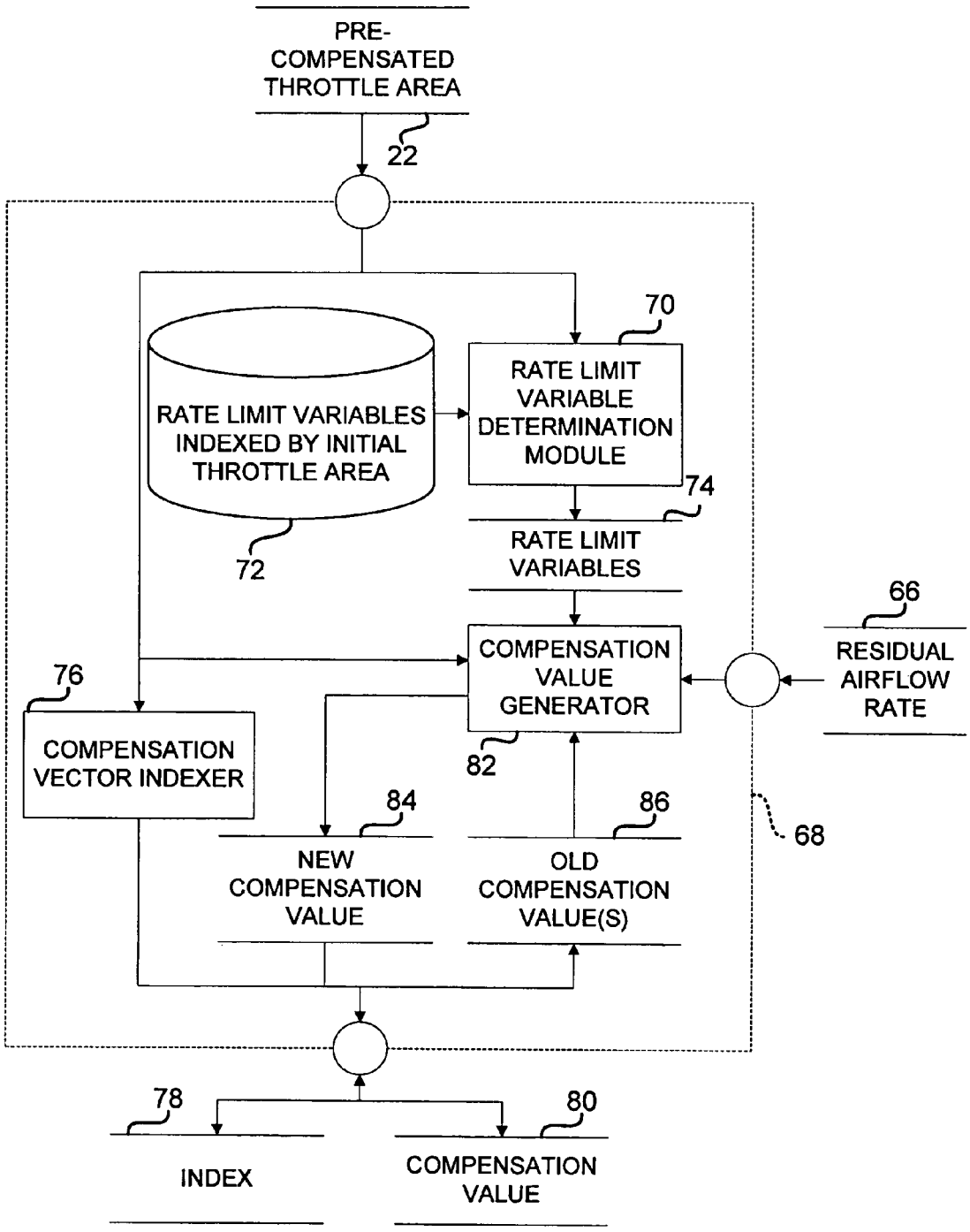
FIG. 4 is a block diagram of a compensation vector development module in accordance with the present invention.

As illustrated in FIG. 4, compensation vector development module 68 utilizes several modules to develop and maintain the datastore of compensation values indexed by desired throttle area. For example, module 68 includes rate limit variable determination module 70 having datastore 72 of rate limit variables indexed by desired throttle area. In operation, module 70 generates rate limit variable 74 based on desired or pre-compensated throttle area 22 and contents of datastore 72. Also, module 68 includes compensation vector indexer 76, which generates index 78 based on desired or pre-compensated throttle area 22. The datastore of compensation values is accessed based on index 78 to retrieve and/or store one or more compensation values 80. These compensation values are associated with index 78 and/or a neighboring index that is offset from index 78 by a predetermined amount of memory.

Module 68 includes compensation value generator 82. Generator 82 rate limits residual airflow rate 66 based on rate limit variables 74 and/or old, neighboring compensation values 86 stored in the datastore. Compensation value generator 82 also generates new compensation value 84 based on three criteria: desired or pre-compensated throttle area 22; rate-limited residual airflow rate 66; and one or more old compensation values 86 associated by offset with index 78. It should be readily understood that the rate limiting can alternatively or additionally be applied to new compensation value 84. For example, the rate limit variable 74 can be applied to rate limit residual airflow rate 66, while old, neighboring compensation values are applied to new compensation value 84 as an additional rate limiting technique. Still further, generator 82 is adapted to replace an old compensation value in the datastore of compensation values. Replacement is accomplished by storing new compensation value 84 in the datastore in association with index 78.

Figure 5:
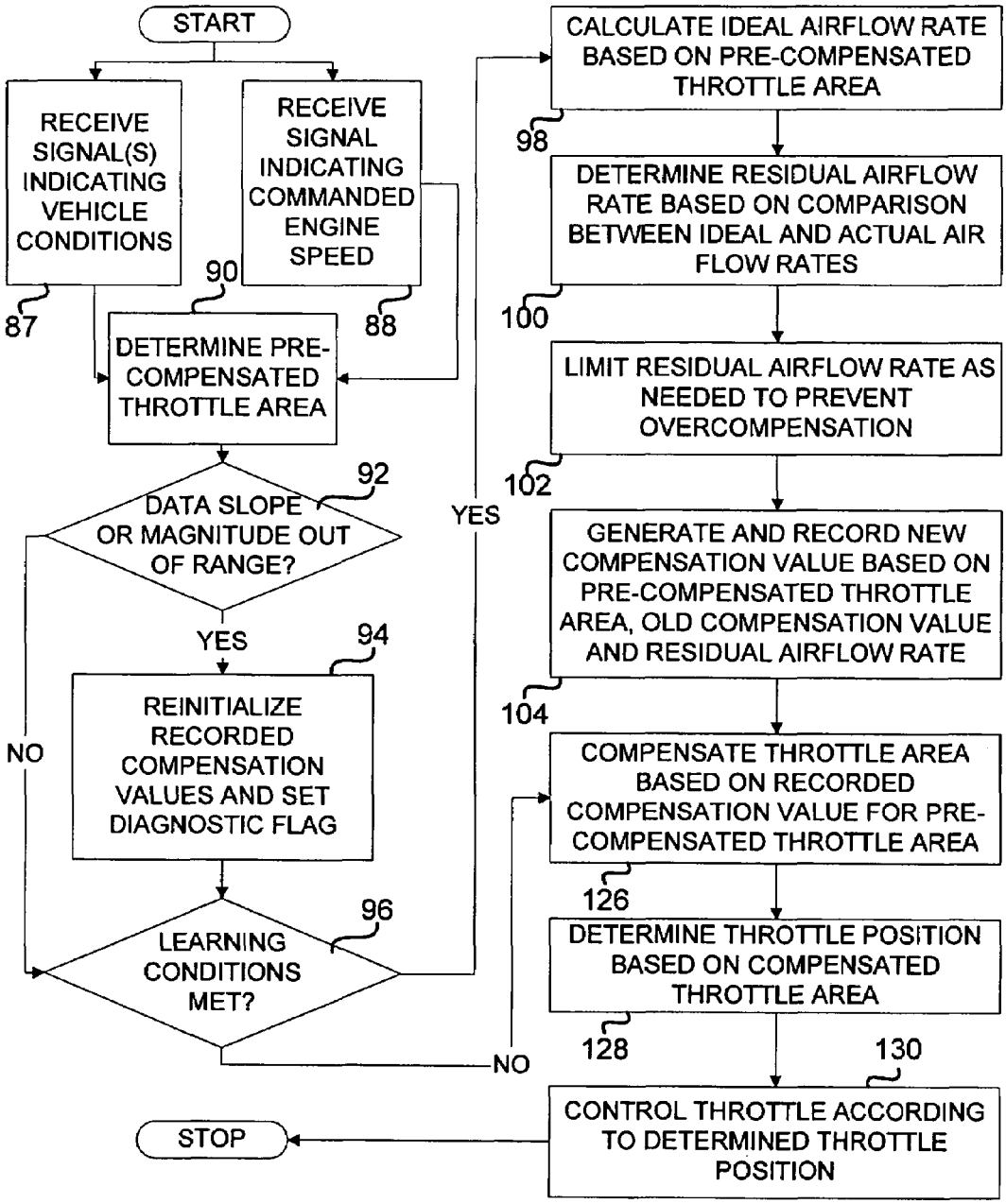
FIG. 5 is a flow diagram depicting integrated methods of electronic throttle control and throttle area compensation in accordance with the present invention.

With reference to FIG. 5, the method according to the present invention includes several steps performed by a vehicle throttle control employing throttle area compensation. For example, the method includes receiving signals indicating sensed vehicle conditions at step 87, and receiving a signal indicating a commanded engine speed at step 88. This information is used to determine a desired throttle area at step 90. Then, if the stored compensation value data slope or magnitude is determined to be out of range as at 92, the data structure storing the compensation value data is reinitialized at step 94. This step ensures that corrupted data is not used to compensate the throttle area. A diagnostic flag may also be set to notify a technician that the memory utilized to store the data is potentially faulty. Next, if learning conditions are deemed met as at 96, then learning is allowed to occur at steps 98–104.

Figure 6:
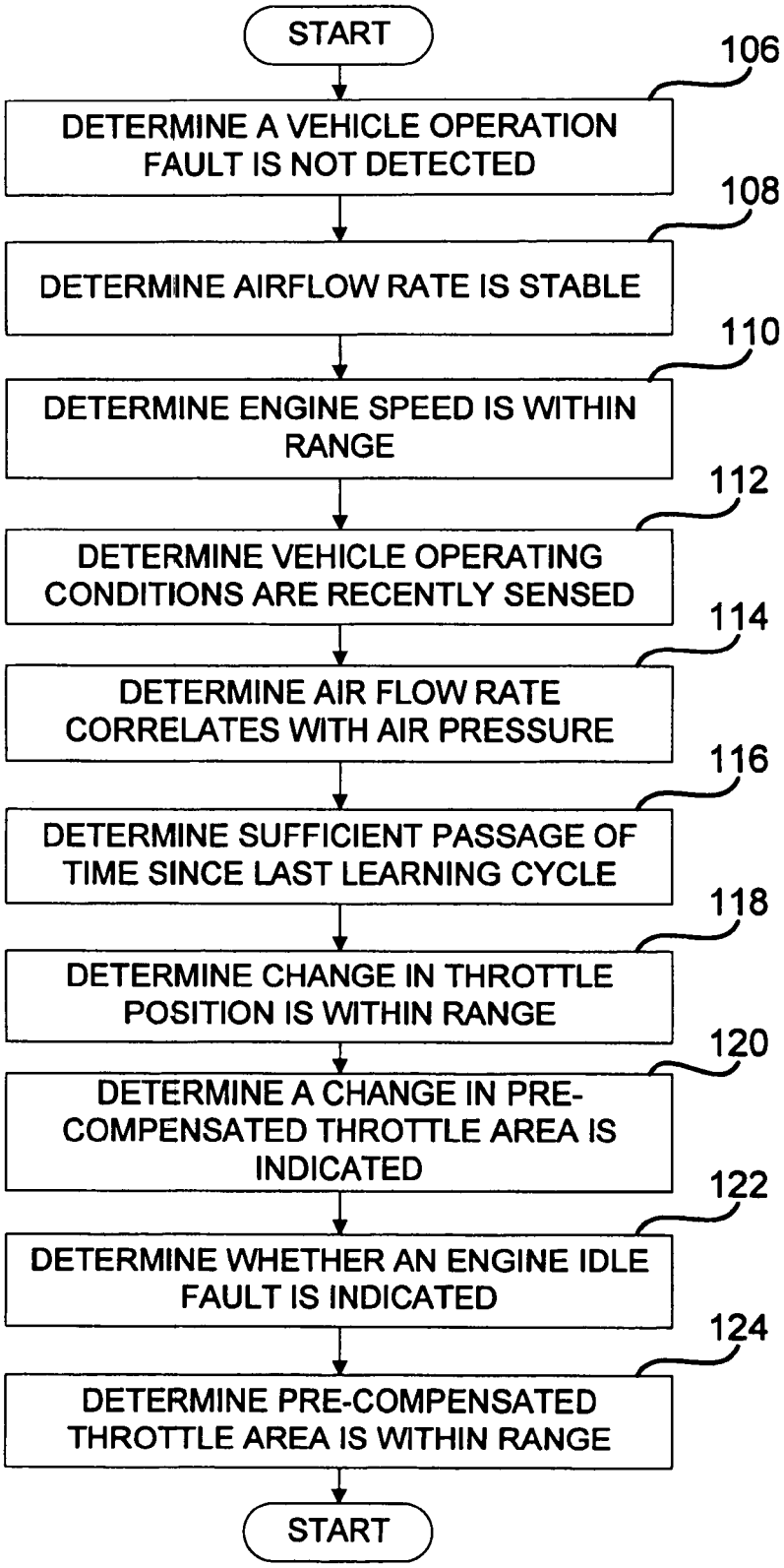
FIG. 6 is a flow diagram depicting learning conditions that is enforced in accordance with the present invention.

Determining if the learning conditions are met at 96 may entail several steps illustrated in FIG. 6. For example, the determination may include determining that a vehicle operation fault is not detected at step 106, and that sensed airflow rate is stable at step 108. The diagnostic flag set in step 94 may therefore inhibit learning if implemented to detect a vehicle operation fault. Also, the determination may include determining that sensed engine speed is within a predetermined range at step 110, and that vehicle operating conditions have been recently sensed at step 112. Further, the determination may include determining that sensed airflow rate correlates with sensed air pressure at step 114, and that a sufficient amount of time has passed since a last learning occurrence at step 116. Still further, the determination may include determining that a change in sensed throttle position is within a predetermined range at step 118, and that a desired change in throttle area is indicated at step 120. Yet further still, the determination may include determining whether an engine idle fault is indicated at step 122, and that the desired throttle area is within a predetermined range at step 124. If any of the conditions embodied in these predetermined criteria are not met, then learning may not be allowed to occur.

Returning to FIG. 5, the learning process includes several steps performed by a vehicle throttle control employing throttle area compensation. For example, the process includes calculating an ideal airflow rate based on desired throttle area at step 98. Also, the process includes determining a residual airflow rate based on a comparison between the ideal airflow rate and an actual airflow rate at step 100. Further, the process includes limiting the residual airflow rate as needed to prevent overcompensation at step 102. Still further, the process includes generating and recording a new compensation value based on desired throttle area, one or more old compensation values, and the limited, residual airflow rate at step 104.

The method according to the present invention includes further steps performed by a vehicle throttle control employing throttle area compensation. For example, the method includes compensating the desired throttle area based on a recorded compensation value for the desired throttle area at step 126. Also, the method includes determining the throttle position based on the compensated throttle area at step 128. Finally, the method includes controlling the vehicle throttle according to the determined throttle position at step 130.

Pseudocode for implementing data validation module 41 (FIG. 2) is provided below, wherein the data structure storing the compensation values corresponds to a table or array, DtTPSC_Pct_AirLrnCorrection, of breakpoints corresponding to cells of flash memory in the vehicle electronic control unit. Essentially, the algorithm checks the data array to determine if the data has been corrupted, and uses a pointer, VeTPSC_AirLrnIndex, to move through the array and check four separate cases. Accordingly, the pointer is at either end of the table, or the slope of the table is increasing or decreasing. Thus, the pointer is used to look at neighboring cells to determine an upper and a lower limit with delta, KeTPSC_Pct_AirLrnMaxDelta. This calibration is demonstrated as a single element calibration, but it may also be an array to allow variable deltas when flexible breakpoints are used in the learn correction table. These high and low limits provide a slope check for the table, and two additional calibrations provide minimum and maximum limits for checking magnitude of table data. In the example below, the slope and magnitude calibrations are performed whenever the table is used or updated. An alternative implementation that saves processor throughput may perform the slope check only when updating the table, and the minimum and maximum range checks when applying the table:

Activate function Determine_High_Low_Limits:

```
IF (VeTPSC__AirLrnIndex = 0)
THEN # First breakpoint
    VeTPSC__Pct__LowerCorrLmt =
        (
        DtTPSC__Pct__AirLrnCorrection(VeTPSC__AirLrnIndex + 1) −
        KeTPSC__Pct__AirLearnMaxDelta
        )
    VeTPSC__Pct__UpperCorrLmt =
        (
        DtTPSC__Pct__AirLrnCorrection (VeTPSC__AirLrnIndex + 1) +
        KeTPSC__Pct__AirLearnMaxDelta
        )
ELSE IF (VeTPSC__AirLrnIndex = (SIZEOF
(DtTPSC__Pct__AirLrnCorrection) −1))
THEN # Last Breakpoint
    VeTPSC__Pct__LowerCorrLmt =
        (
        DtTPSC__Pct__AirLrnCorrection (VeTPSC__AirLrnIndex − 1) −
        KeTPSC__Pct__AirLrnMaxDelta
        )
    VeTPSC__Pct__UpperCorrLmt =
        (
        DtTPSC__Pct__AirLrnCorrection (VeTPSC__AirLrnIndex − 1) +
        KeTPSC__Pct__AirLrnMaxDelta
```

-continued

```
        )
ELSE IF (DtTPSC__Pct__AirLrnCorrection
(VeTPSC__AirLrnIndex + 1) >=
        DtTPSC__Pct__AirLrnCorrection (VeTPSC__AirLrnIndex − 1))
 THEN # Increasing slope correction table
    VeTPSC__Pct__LowerCorrLmt =
        (
        DtTPSC__Pct__AirLrnCorrection (VeTPSC__AirLrnIndex + 1) −
        KeTPSC__Pct__AirLrnMaxDelta
        )
    VeTPSC__Pct__UpperCorrLmt =
        (
        DtTPSC__Pct__AirLrnCorrection (VeTPSC__AirLrnIndex − 1) +
        KeTPSC__Pct__AirLrnMaxDelta
        )
ELSE # Decreasing slope correction table
    VeTPSC__Pct__LowerCorrLmt =
        (
        DtTPSC__Pct__AirLrnCorrection (VeTPSC__AirLrnIndex − 1) −
        KeTPSC__Pct__AirLrnMaxDelta
        )
    VeTPSC__Pct__UpperCorrLmt =
        (
        DtTPSC__Pct__AirLrnCorrection (VeTPSC__AirLrnIndex + 1) +
        KeTPSC__Pct__AirLrnMaxDelta
        )
END IF
IF (VeTPSC__Pct__UpperCorrLmt >= VeTPSC__Pct__LowerCorrLmt)
THEN # Normal Case
    LeTPSC__Pct__AirLrnCorrAppId =
        (
        DtTPSC__Pct__AirLrnCorrection (VeTPSC__AirLrnIndex)
        )
    IF ((LeTPSC__Pct__AirLrnCorrAppId >
        KeTPSC__Pct__AirLrnPosLmt) ||
        (LeTPSC__Pct__AirLrnCorrAppId <
        KeTPSC__Pct__AirLrnNegLmt) ||
        (LeTPSC__Pct__AirLrnCorrAppId >
        VeTPSC__Pct__UpperCorrLmt) ||
        (LeTPSC__Pct__AirLrnCorrAppId <
        VeTPSC__Pct__LowerCorrLmt))
    THEN # The learn correction array (only the current point)
    is corrupted,
            # clear array.
    DeTPSC__b__AirLrnCorrArrayReset =TRUE
    FOR (
        (LeTPSC__Index = 0) TO
        (SIZEOF(DtTPSC__Pct__AirLrnCorrection) − 1)
        )
            DtTPSC__Pct__AirLrnCorrection (LeTPSC__Index) = 0
    NEXT LeTPSC__Index
    END IF
ELSE #If we get here, then learn correction array (either current point or
    #neighboring point) is corrupted due to the slope being too
    large, thus the
    #entire array is cleared
    DeTPSC__b__AirLrn__CorrArrayRest = TRUE
    FOR (
        (LeTPSC__Index = 0) TO
        (SIZEOF (DtTPSC__Pct__AirLrnCorrection) −1)
        )
            DtTPSC__Pct__AirLrnCorrection (LeTPSC__Index) = 0
    NEXT LeTPSC__Index
END IF
```

End function Determine_High_Low_Limits

Pseudocode for implementing throttle area compensation module 36, and compensation vector learning module 40 to develop, maintain, and use compensation datastore 38 is further provided below:

Activate function Learn_And_Correct:

```
IF (FAULT_PENDING (MAP, MAF, IAT, Reduced_Engine_Power))
THEN # Bypass Learning this key cycle
        Air_Learn_Inhibit_Flag = true
END IF
IF      (       (MAF_Stable_Flag=true)
        AND     (Engine_Speed>KE_AIR_LEARN_ENGINE_SPEED_MIN)
        AND     (Engine_Speed<KE_AIR_LEARN_ENGINE_SPEED_MAX)
        AND     (ABS(MAP_airflow-MAF_airflow)<
                KE_Air_Learn_Airflow_Correlation_Threshold)
        AND     (BARO_Updated_Recently_Timer<KE_BARO_UPDATE_TIMER)
        AND     (Air_Learn_Stability_Timer>KE_Air_Learn_Stab_Timer)
        AND     (ABS(INDICATED_Throttle_POSITION_1_Old -
                        INDICATED_Throttle_POSITION)<
                KE_Air_Learn_Desired_Throttle_Area_Stability)
        AND     (Idle Speed High/Low=false) #This is a fault test
        AND     (Desired_Throttle_Area_Unmod < 6.875)
        )
THEN # Allow learning to proceed
        Air_Learn_Inhibit_Flag=false
ELSE #Bypass learning for this loop
        Air_Learn_Inhibit_Flag=true
END IF
```

Increment (Air_Learn_Stability_Timer)

Next, determine the learned cell index number where

Air_Learn_Max_Throttle_Area is the largest throttle area divided by the # breakpoint in the table Index_Quotient=local variable Index_Quotient=limit(Desired_Throttle_Area_Unmod/Air_Learn_Max_Throttle_Area)

Next, limit index to values from zero to one

Index=ROUND[(Index_Quotient)*SIZE(Air_Learn_Correction)]

Next, calculate ideal airflow based on desired throttle area unmodified

Air_Learn_Airflow=(Desired_Throttle_Area_Unmod/KE_IDLE_AREA$_{_SCALAR}$)*$_{Air}$_Density*Speed_Of_Sound*Phi

Next, calculate the residual airflow

Air_Learn_Residual=(Air_Learn_Airflow−MAF_Airflow)/(MAF_Airflow)

Alternatively, residual airflows from the two previous loops may be stored and # averaged with the residual airflow of the current loop

Next, rate limit the residual airflow

```
IF (Air_Learn_Residual > zero)
THEN
        Rate_Limit_Var=lookup(Desired_Throttle_Area_Unmod,
                                        KV_Air_Learn_Rate_Limit_Up)
ELSE
        Rate_Limit_Var=negative*lookup(Desire_Throttle_Area_Unmod,
                                        KV_Air_Learn_Rate_Limit_Dn)
END IF
IF      (
        abs(Air_Learn_Residual*Desired_Throttle_Area_Unmod) >
        abs(Rate_Limit_Var)
        )
THEN
        Air_Learn_Modifier = Rate_Limit_Var +
        Air_Learn_Correction(Index)
ELSE
        Air_Learn_Modifier = (
                                Air_Learn_Residual *
                                Desired_Throttle_Area_Unmod +
                                Air_Learn_Correction (Index)
                                )
END IF
```

#Next, determine high and low limits

First, declare local variables

Air_Learn_At_Index_Minus=lookup(Air_Learn_Correction(Index−1)

Air_Learn_At_Index_Plus=lookup(Air_Learn_Correction (Index+1)

Declare variables for temporary storage of limit values for determining cell # learning

Limit_Index_Minus=init to zero

Limit_Index_Plus=init to zero

```
IF (index = min__index__value)
THEN
    Limit__Index__Minus = Limit__Index__Plus
END IF
IF (index = max__index__value)
THEN
    Limit__Index__Plus = Limit__Index__Minus
END IF
IF (Air__Learn__At__Index__Minus = Air__Learn__At__Index__Plus)
THEN
    Limit__Index__Minus = (Air__Learn__At__Index__Minus −
                                KE__AIR__LEARN__MAX__DELTA)
    Limit__Index__Plus = (Air__Learn__At__Index__Plus__+
                                KE__AIR__LEARN__MAX__DELTA)
ELSE
    IF  (
        abs(Air__Learn__At__Index__Minus +
            KE__AIR__LEARN__MAX__DELTA −
            Air__Learn__At__Index__Plus)
        <
        abs(Air__Learn__At__Index__Minus −
            KE__AIR__LEARN__MAX__DELTA −
            Air__Learn__At__Index__Plus)
        )
    THEN
        Limit__Index__Minus = (Air__Learn__At__Index__Minus +
                                    KE__AIR__LEARN__MAX__DELTA)
    ELSE
        Limit__Index__Minus = (Air__Learn__At__Index__Minus −
                                    KE__AIR__LEARN__MAX__DELTA)
    END IF
    IF   abs(Air__Learn__At__Index__Plus + KE__AIR__LEARN__MAX__DELTA −
             Air__Learn__At__Index__Minus)
        <
        abs(Air__Learn__At__Index__Plus −
             KE__AIR__LEARN__MAX__DELTA −
             Air__Learn__At__Index__Minus)
    THEN
        Limit__Index__Plus = (Air__Learn__At__Index__Plus +
                                    KE__AIR__LEARN__MAX__DELTA)
    ELSE
        Limit__Index__Plus = (Air__Learn__At__Index__Plus −
                                    KE__AIR__LEARN__MAX__DELTA)
    END IF
END IF
# Next, limit the air learn modifier term
IF (Limit__Index__Plus > Limit__Index__Minus)
THEN
    IF (Air__Learn__Modifier > Limit__Index__Plus)
    THEN
        Air__Learn__Modifier = Limit__Index__Plus
    END IF
    IF (Air__Learn__Modifier < Limit__Index__Minus)
    THEN
        Air__Learn__Modifier = Limit__Index__Minus
    END IF
ELSE
    IF (Air__Learn__Modifier > Limit__Index__Minus)
    THEN
        Air__Learn__Modifier = Limit__Index__Minus
    END IF
    IF (Air__Learn__Modifier < Limit__Index__Plus)
    THEN
        Air__Learn__Modifier = Limit__Index__Plus
    END IF
END IF
IF (Air__Learn__Modifier >= KE__AIR__LEARN__LIMIT)
THEN
        Air__Learn__Modifier = KE__AIR__LEARN__LIMIT
END IF
Air__Learn__Correction (Index) = Air__Learn__Modifier
Set__Timer (Air__Learn__Stab__Timer)
# Finally, apply the learned correction to the final desired throttle area
Air__Learn__Correction__Applied = (lookup(Air__Learn__Correction(
                                    Desired__Throttle__Area__Unmod)))
IF (Air__Learn__Correction__Applied > KE__AIR__LEARN__LIMIT)
THEN
    Air__Learn__Correction__Applied = KE__AIR__LEARN__LIMIT
END IF
```

-continued

```
IF (Idle_Area+Air_Learn_Correction_Applied >= KE_Max_Idle_Area)
    Air_Learn_Correction_Applied = KE_Max_Idle_Area-Idle_Area
END IF
```

Desired_Throttle_Area_Var=Throttle_Area+Air_Learn-_Correction_Applied End function Learn_And_Correct The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A throttle area compensation system for use with an electronic throttle control of a vehicle, comprising:

a compensation datastore of compensation values indexed by pre-compensated throttle area;

a compensation vector learning module receiving a pre-compensated throttle area and at least one sensed vehicle condition, and informing the compensation datastore based on the pre-compensated throttle area and the sensed vehicle condition; and a throttle area compensation module communicating with the compensation datastore, receiving the pre-compensated throttle area, and determining a compensated throttle area based on the pre-compensated throttle area and a corresponding compensation value of the compensation data store.

2. The system of claim 1, wherein said compensation vector learning module includes an ideal airflow rate calculation module determining an ideal airflow rate based on the pre-compensated throttle area, and an airflow rate comparison module determining a residual airflow rate based on the ideal airflow rate and a sensed airflow rate of the vehicle.

3. The system of claim 2, wherein the compensation vector learning module includes a compensation vector development module at least one of:

limiting the residual airflow rate to prevent overcompensation of the pre-compensated throttle area; and averaging a predetermined number of previously generated residual airflow rates stored in memory with the residual airflow rate to improve accuracy and reduce variation in throttle are compensation.

4. The system of claim 3, wherein said compensation vector development module determines an upper rate limit corresponding to the pre-compensated throttle area and a lower rate limit corresponding to the pre-compensated throttle area, rate limits the residual airflow rate by replacing the residual airflow rate with the upper rate limit in the event the residual airflow rate exceeds the upper rate limit, and by replacing the residual airflow rate with the lower rate limit in the event the lower rate limit exceeds the residual airflow rate.

5. The system of claim 3, wherein said vector compensation module retrieves neighboring compensation values from memory that neighbor the pre-compensated throttle area, determines an upper rate limit and a lower rate limit based on the neighboring compensation values and predetermined range modifiers, and limits the residual airflow rate by replacing the residual airflow rate with the upper rate limit in the event the residual airflow rate exceeds the upper rate limit, and by replacing the residual airflow rate with the lower rate limit in the event the lower rate limit exceeds the residual airflow rate.

6. The system of claim 2, wherein said compensation vector learning module includes a compensation vector development module receiving the residual airflow rate and the pre-compensated throttle area, determining a new compensation value based on the residual airflow rate and an old compensation value of the compensation datastore corresponding to the pre-compensated throttle area, and recording the new compensation value in the compensation datastore in correspondence with the pre-compensated throttle area.

7. The system of claim 1, wherein said compensation vector learning module includes a learning conditions enforcement module receiving at least one of the pre-compensated throttle area, the plurality of sensed vehicle conditions, and a time-dependent input, and preventing said compensation vector learning module from informing said compensation datastore if predetermined learning conditions are not deemed met based on at least one of the pre-compensated throttle area, the plurality of sensed vehicle conditions, and the time-dependent input.

8. The system of claim 7, wherein said learning conditions enforcement module prevents said compensation vector learning module from informing said compensation datastore if at least one of:

a vehicle operation fault is detected;

airflow rate is not stable in accordance with predetermined criteria;

engine speed is not within a predetermined range;

sensed vehicle operating conditions have not been sensed recently;

sensed airflow rate does not correlate with sensed air pressure;

engine idle is not within a predetermined range;

a sufficient amount of time has not passed since a last learning cycle;

a change in throttle position is not within a predetermined range; and pre-compensated throttle area is not within a predetermined range.

9. The system of claim 1, comprising a throttle position determination module communicating with a throttle position datastore of throttle positions indexed by throttle area, receiving the compensated throttle area, and determining a throttle position based on the compensated throttle area.

10. The system of claim 1, comprising a throttle area determination module receiving a commanded engine speed and a plurality of sensed vehicle conditions, and determining the pre-compensated throttle area based on the commanded engine speed and the plurality of sensed vehicle conditions.

11. The system of claim 1, comprising a throttle control module receiving the throttle position, and controlling a throttle of a vehicle producing the sensed vehicle conditions based on the throttle position.

12. The system of claim 1, comprising a data validation module evaluating the compensation values of said compensation datastore to determine whether the compensation values are valid, and reinitializing said compensation datastore if the compensation values are not determined to be valid.

13. The system of claim 12, wherein said data validation module determines whether neighboring compensation values exhibit a slope that falls within a predetermined range, and determines whether individual compensation values fall within a predetermined range.

14. The system of claim 12, wherein said data validation module sets a diagnostic flag indicative of a defect in said compensation datastore based on whether the compensation values are determined to be valid.

15. A throttle area compensation method for use with an electronic throttle control of a vehicle, comprising:

calculating an ideal airflow rate based on a pre-compensated throttle area;

determining a residual airflow rate based on a comparison between the ideal airflow rate and an actual airflow rate of the vehicle; and compensating pre-compensated throttle area based on the residual airflow rate.

16. The method of claim 15, wherein said step of compensating pre-compensated throttle area includes compensating the pre-compensated throttle area based on a compensation value associated in memory with the pre-compensated throttle area, the method further comprising a learning step including:

generating a new compensation value based on the residual airflow rate and an old compensation value associated in memory with the pre-compensated throttle area; and replacing the old compensation value by associating the new compensation value in memory with the pre-compensated throttle area.

17. The method of claim 16, comprising:

determining whether predetermined learning conditions have been met based on at least one of sensed vehicle conditions, the pre-compensated throttle area, and a time-dependent input; and preventing said learning step from occurring if the predetermined learning conditions have not been met.

18. The method of claim 17, wherein said step of determining whether predetermined learning conditions have been met includes at least one of:

determining that a vehicle operation fault is not detected;

determining whether airflow rate is stable in accordance with predetermined criteria;

determining whether engine speed is within a predetermined range;

determining whether the sensed vehicle operating conditions have been sensed recently;

determining whether sensed airflow rate correlates with sensed air pressure;

determining that engine idle is within a predetermined range;

determining that a sufficient amount of time has passed since a last learning cycle;

determining that a change in throttle position is within a predetermined range; and determining that the pre-compensated throttle area is within a predetermined range.

19. The method of claim 15, comprising at least one of:

limiting the residual airflow rate to prevent overcompensation of the pre-compensated throttle area; and averaging a predetermined number of previously generated residual airflow rates stored in memory with the residual airflow rate to improve accuracy and reduce variation in throttle are compensation.

20. The method of claim 19, comprising:

determining an upper rate limit corresponding to the pre-compensated throttle area and a lower rate limit corresponding to the pre-compensated throttle area; and rate limiting the residual airflow rate by replacing the residual airflow rate with the upper rate limit in the event the residual airflow rate exceeds the upper rate limit, and by replacing the residual airflow rate with the lower rate limit in the event the lower rate limit exceeds the residual airflow rate.

21. The method of claim 19, comprising:

retrieving neighboring compensation values from memory that neighbor the pre-compensated throttle area;

determining an upper rate limit and a lower rate limit based on the neighboring compensation values and predetermined range modifiers; and limiting the residual airflow rate by replacing the residual airflow rate with the upper rate limit in the event the residual airflow rate exceeds the upper rate limit, and by replacing the residual airflow rate with the lower rate limit in the event the lower rate limit exceeds the residual airflow rate.

22. The method of claim 15, comprising:

determining a throttle position based on compensated throttle area; and controlling a throttle of the vehicle producing the sensed vehicle conditions based on the throttle position.

23. The method of claim 15, comprising:

sensing the actual airflow rate of the vehicle; and determining the pre-compensated throttle area based on a commanded engine speed.

* * * * *